US008933971B2

(12) United States Patent
Washington et al.

(10) Patent No.: US 8,933,971 B2
(45) Date of Patent: Jan. 13, 2015

(54) SCALE FACTORS FOR VISUAL PRESENTATIONS

(75) Inventors: David Washington, Seattle, WA (US); Jan-Kristian Markiewicz, Redmond, WA (US); Raymond Jui-Mong Chen, Redmond, WA (US); Ethan Nelson Ray, Redmond, WA (US); Eric Hebenstreit, Kirkland, WA (US); David Burg, Newcastle, WA (US); Petru Iulian Cociorva, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 46 days.

(21) Appl. No.: 13/230,445

(22) Filed: Sep. 12, 2011

(65) Prior Publication Data

US 2013/0063492 A1 Mar. 14, 2013

(51) Int. Cl.
*G09G 5/00* (2006.01)

(52) U.S. Cl.
CPC ..... *G09G 5/003* (2013.01); *G09G 2340/0407* (2013.01); *G09G 2370/04* (2013.01)
USPC ..... 345/669

(58) Field of Classification Search
USPC ..... 345/667
See application file for complete search history.

(56) References Cited

U.S. PATENT DOCUMENTS

| | | | | |
|---|---|---|---|---|
| 6,213,653 | B1 | 4/2001 | Borg et al. | |
| 6,339,428 | B1 * | 1/2002 | Fowler et al. | 345/582 |
| 6,549,214 | B1 | 4/2003 | Patel et al. | |
| 7,180,531 | B2 | 2/2007 | Gery et al. | |
| 7,525,551 | B1 * | 4/2009 | Newhall et al. | 345/587 |
| 7,689,583 | B2 | 3/2010 | Bozich et al. | |
| 7,689,908 | B2 | 3/2010 | Yan et al. | |
| 2003/0095135 | A1 * | 5/2003 | Kaasila et al. | 345/613 |
| 2004/0075671 | A1 * | 4/2004 | Vale et al. | 345/660 |
| 2005/0012723 | A1 | 1/2005 | Pallakoff | |
| 2006/0158451 | A1 * | 7/2006 | Barenbrug et al. | 345/582 |
| 2008/0030425 | A1 * | 2/2008 | Fullerton et al. | 345/1.1 |
| 2008/0065668 | A1 | 3/2008 | Spence et al. | |

OTHER PUBLICATIONS

Haveson, Ryan, and Ken Sykes. "Writing DPI-Aware Win32 Applications." Microsoft Corporation. N.p., n.d. Web. Mar. 27, 2013. <download.microsoft.com/download/1/f/e/1fe476f5-2b7a-4af1-a0ed-768454a0b5b1/Writing%20DPI%20Aware%20Applications.pdf>.*

"Overview of Resolution Independence" Retrieved at: https://developer.apple.com/library/mac/documentation/UserExperience/Conceptual/HiDPIOverview/HiDPIConcepts/HiDPIConcepts.html Retrieved Date: Jun. 7, 2011 Published Date: May 4, 2007 pp. 1-7.

* cited by examiner

*Primary Examiner* — David Zarka
*Assistant Examiner* — Vu Nguyen
(74) *Attorney, Agent, or Firm* — Bryan Webster; Kate Drakos; Micky Minhas

(57) ABSTRACT

A device may display a presentation of elements (e.g., icons) on a display component. However, display components have a pixel density that affects aesthetic and practical aspects of the presentation (e.g., rendering the presentation at a variable and inconsistent size); yet, many presentations are not generated in view of the pixel density of the display component of the device. Presented herein are techniques for generating and displaying a presentation of elements in view of the pixel density of the display component, using a scale factor set of scale factors that specify a pixel density range and a scale factor value (e.g., 120%) to be applied to the elements of the presentation. The scale factor set may be kept small to reduce the administrative burden on the designer of the element, while also achieving approximately consistent sizing of the presentation on display components having variable pixel densities.

20 Claims, 10 Drawing Sheets

SCALE FACTORS FOR VISUAL PRESENTATIONS

BACKGROUND

Within the field of computing, many scenarios involve a visual presentation of elements, such as thumbnail images of an image gallery, or the icons and controls comprising a graphical user interface. Such presentations may be generated and displayed on a display component of a device, either directly (e.g., where the display component is accessible to the device, the device may generate a bitmap that is blitted onto the display component by a hardware component) or indirectly (e.g., the display component may be attached to a client device, and a webserver may generate and send to the client device a web page, comprising a set of elements embedded in a web document, which the client device may render within the web browser). Users may also interact with the presentations in different ways; e.g., a presentation on a workstation computer may involve interaction with a pointing device such as a mouse or trackball, while a mobile device may involve a touch-sensitive display that enables touch input from a fingertip or stylus.

A particular characteristic of display components that may affect presentations rendered thereupon is the pixel density of the display component, such as a pixels-per-centimeter measurement. It may be appreciated that such characteristics may be independent of the size of the display component (e.g., two display components of the same size may present different pixel densities; conversely, two display components of different sizes may present the same pixel density) and/or the pixel dimensions of the display component (e.g., two display components displaying a presentation with a particular pixel dimensions may do so with different physical sizes). However, the variable pixel densities of different display components may produce some difficulties in the rendering of a presentation on the display components. In particular, applications and application platforms (including the operating system of a device) are often cognizant of the pixel dimensions of the display component, and may take the pixel dimensions into account while preparing a presentation (e.g., web browsers are often configured to adjust the layout of the web page based on the pixel width of the web browser, e.g., by scaling the horizontal pixel widths of relatively sized elements in proportion with the pixel width of the web browser). However, such applications and application platforms less frequently adapt the presentation in view of the pixel density of the display component. Thus, two devices having display components with different horizontal pixel dimensions may adapt the presentation in view of the different pixel counts, but may fail to adapt the presentation in view of different pixel densities of the display components. The elements presented on such displays may therefore have equal pixel widths, but different presented widths in terms of the visual sizes of the elements visualized on the display components. Indeed, in many such devices, the display components may not be configured to report a pixel density; the device may therefore be unable to determine the pixel density of the display components and/or to adjust the presentation to depict elements of a particular apparent size.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Some techniques have been devised to adjust presentations in view of the pixel density of a display component. As a first example, automated scaling may be applied to adjust the elements to a desired literal size; however, such automated scaling may yield blurry or otherwise undesirable artifacts of the adjustment. As a second example, the device may detect the pixel density of the display component, and the device may request each element to generate a scaled representation in view of the pixel density of the display. However, because the presentation may be displayed on a large number of display components, the elements may have to support a wide range of pixel densities, resulting in an overly complex and/or resource-intensive presentation of elements.

The techniques presented herein may be utilized to generate a presentation of elements that is adjusted in view of the pixel density of the display component upon which the presentation is to be displayed. In accordance with these techniques, a scale factor set may be selected, comprising a small number of scale factors that are respectively used to adjust a presentation for displays having pixel densities within a pixel density range. For example, a pixel density set may include a 100% scale factor for display components having pixel densities from 8,000 pixels/square unit to 12,000 pixels/square unit; an 80% scale factor for display components having pixel densities less than 8,000 pixels/square unit; a 140% scale factor for display components having pixel densities from 12,000 to 15,000 pixels/square unit; and a 180% scale factor for display components having pixel densities greater than 15,000 pixels/square unit. In this example, respective elements are configured to generate four scaled representations, each presenting the same content but rendered within different pixel dimensions, and an embodiment of these techniques may display one of the four scaled representations of respective elements in a presentation based on the pixel density of the display component. The presentation therefore includes elements with approximately the same visual dimensions on different display components, regardless of the sizes, pixel dimensions, and/or pixel densities of the display components. While the use of a particular scale factor for a range of pixel densities may result in a wider range of variation than other techniques, the techniques presented herein achieve such scaling without automatically and arbitrarily scaling the elements and without configuring the elements to support a large number of pixel densities, and may therefore present an advantageous tradeoff of scaling, quality, and performance.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
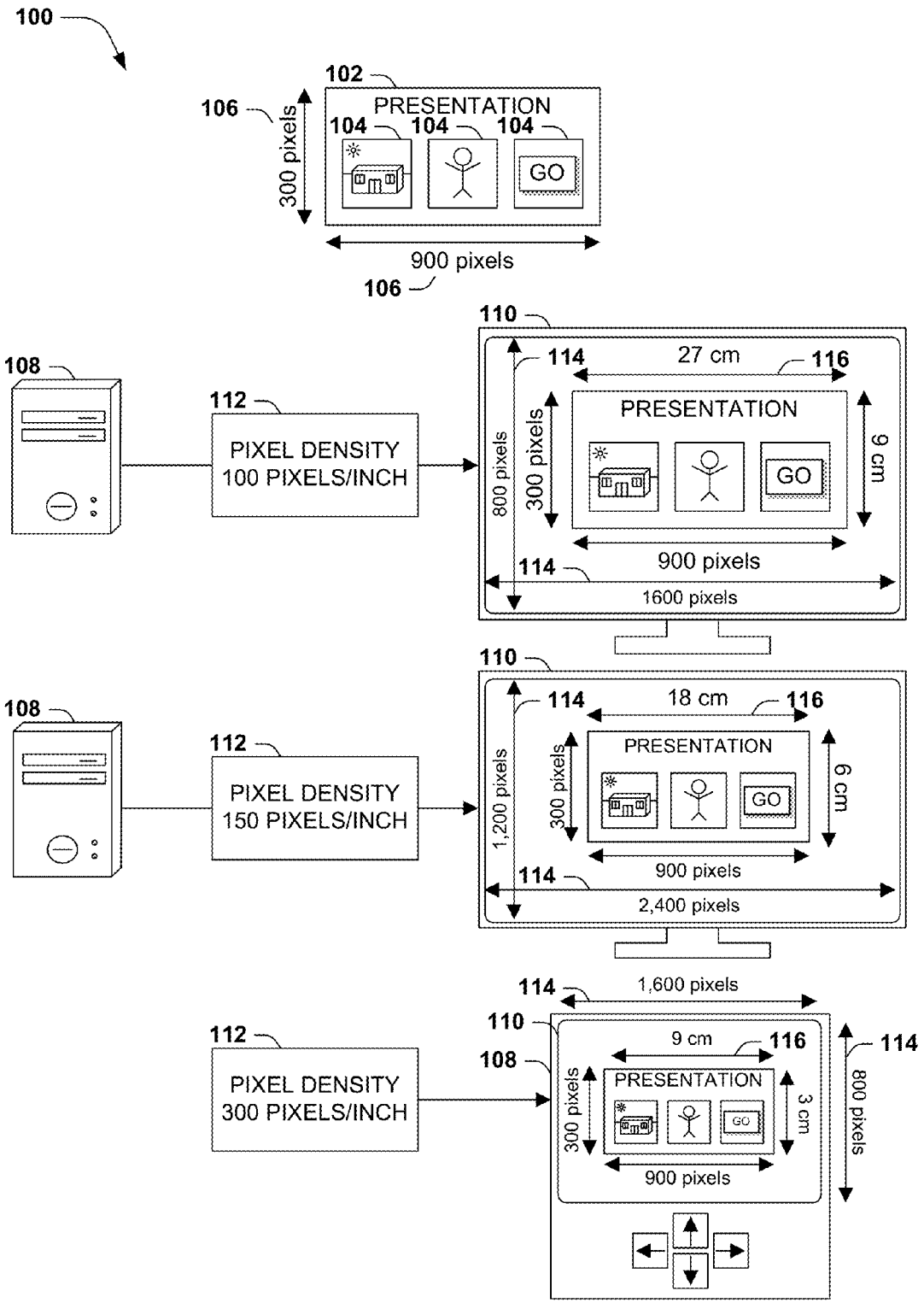
FIG. 1 is an illustration of an exemplary scenario featuring a presentation displayed on a set of display components.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

A. Introduction

Within the field of computing, many scenarios involve a presentation of elements on a display component of a device. As a first example, the presentation may comprise an image collection, such as a photo album, a set of icons, or a clip art gallery, and the presentation may comprise a depiction, thumbnail set, or index of the images of the collection. As a second example, the presentation may comprise a graphical user interface including a set of interactive controls having a graphical representation, such as buttons, checkboxes, and textboxes. As a third example, the presentation may comprise a set of interrelated visual components in a design drawing, e.g., an architectural blueprint, manufacturing schematic, or circuit diagram.

These and other presentations of elements may be generated and displayed on various types of devices. Such presentations are often displayed on a display component of a device, such as a cathode-ray television, a liquid crystal display (LCD), a light-emitting diode (LED) array, a plasma display, or a projector. Such display components may have various properties, such as physical size, color depth (e.g., monotone, grayscale, or varying ranges of color), refresh rate, and sensitivity to touch input. In order to render output on such display components, devices often generate the presentation as a data set, such as a bitmap (e.g., an array of color values for respective pixels of the display), that is rendered by a hardware blitter onto the display surface of the display component. Other presentations may be generated by a first device and delivered as a higher-level presentation to a second device for presentation on a display component attached thereto. For example, a webserver may generate a presentation to be displayed on a display component of a web client (e.g., a computer executing a web browser), and may therefore present a web page specifying a layout of embedded elements (e.g., text, drawn shapes, and images).

The appearance of the presentation on different display components may vary due to the characteristics of the particular display component. For many such characteristics, the designers of such presentations may predict the range of characteristics of such display components whereupon the presentation may be viewed, and may design the presentation to be rendered in an acceptable manner for any predicted combination of characteristics. As a first example, a designer may configure a presentation for acceptable rendering at a range of pixel dimensions; e.g., web pages are often designed with a flow layout that positions text in a readable manner despite the horizontal width of the presentation. As a second example, a designer may design a presentation as alternatively presenting high-color images for display components having a high color depth and low-color or grayscale images for display components having low color depth. Presentations may also vary based on the properties of the device; e.g., a web page may present a highly interactive interface for devices having plentiful computing resources or a less interactive interface for portable devices having limited computing resources (e.g., a web page having a "full version" and a "mobile version"). Additionally, users of such devices often understand the properties of such display components and the variations in the presentation on different devices, and may use this understanding while purchasing and using such devices. For example, a user may adjust the pixel dimensions of a display component of a device in order to achieve a larger or smaller operating environment. Different devices may also inspire a different usage by users; e.g., a user may view a mobile device at a comparatively near distance, an LCD display of a workstation at a comparatively medium distance, and a home theater presentation at a comparatively far distance.

However, one characteristic that may vary significantly among display components, but that is less familiar to users, is the pixel density of the display component, such as the number of pixels that are displayed along a particular dimension or in an area of a particular physical size. In some cases, users may be indirectly familiar with this concept; e.g., by adjusting the pixel dimensions of a display component, the user may appreciate that the operating environment becomes larger or smaller and that elements within the operating environment appear larger or smaller, but may not directly understand that such adjustments alter the pixel density of the display component. Thus, if the user views an image scaled up to a full-screen presentation while the operating environment is presented at different pixel dimensions, the user may observe the image as the same physical size (scaled to take up the entire display surface), and may notice that the visual quality of the image varies, but may not understand why—i.e., because altering the pixel dimensions of the display component varies the pixel density of the display component and affects the amount of detail included in the display component.

Developers may also not fully appreciate the consequences of pixel density while designing a presentation. For example, the presentation may be adaptable for display in a particular manner at particular pixel dimensions, but may not be adaptive to the pixel density of the display component. As a result, the presentation appears of different sizes and/or quality when viewed on different display components. For example, a 1,024-pixel-wide web page may appear of an adequate size when rendered at a first pixel density on a display component of a notebook computer. However, when viewed as a 1,024-pixel-wide web page on a portable device (which may present a much higher pixel density in order to render such presentations on a smaller display component), the presentation may be illegibly small. Conversely, when viewed as a 1,024-pixel-wide web page on a large display component having a low pixel density (e.g., a 1.3-meter LCD display of a home theater system), the presentation may appear very large. Such variations may significantly impact the visual quality and usability of the presentation, but developers often do not design presentations to adapt to the pixel density of the display component. This failure is at least partly due to the difficulty in querying the pixel density of the display component; e.g., many older devices and platforms (such as older web browsers) failed to provide a mechanism for querying the pixel density of the presentation. Nevertheless, such variations may significantly impact the quality and usability of the presentation.

FIG. 1 presents an illustration of an exemplary scenario 100 featuring a variable appearance on different display components having different pixel densities. In this exemplary scenario 100, a presentation 102 comprising a set of elements 104 (e.g., a small image, a stylized icon, and a graphical user interface control) is rendered at a particular logical size 106 (e.g., 900 pixels by 300 pixels). This presentation may be generated and/or received by various devices 108 and presented on a display component 110. However, variations in the pixel densities 112 of the display components 110 may alter the appearance of the presentation 102. For example, a first device 108 may render the presentation on a first display component 110 having particular pixel dimensions 114, such as 1,600×800 pixel dimensions of the operating environment of the device 108. When rendered upon this display component 110, the presentation 102 may appear with a particular physical size 116, e.g., 27 centimeters by 9 centimeters. However, when presented with the same logical size 106 (e.g., still 900 pixels by 300 pixels) on a second display component 110 of the same physical size but having different pixel dimensions (and thus presenting a different pixel density 112), the presentation 102 presents a different physical size 116 (e.g., 18 centimeters by 6 centimeters). Additionally, when presented at the same logical size 106 on a third device 108 having display component 110 with an even higher pixel density 112 (e.g., a portable device featuring a high-quality display), the presentation 102 may appear at an even smaller physical size 116 (e.g., 9 centimeters by 3 centimeters).

It may be appreciated that such variations in the physical sizes 116 of the presentation 102 are not directly related to the size of the display component 110 (e.g., the first and second display components are of the same size, but have different pixel dimensions 114, thus resulting in different pixel densities 112), the pixel dimensions 114 of the display component 110 (e.g., two devices 108 may have display components 110 having the same pixel dimensions 114, but may be of different physical sizes, and may therefore present different pixel densities 112); or the size or type of device (e.g., a portable device 108 may include a small display component 110 with a lower, higher, or equal pixel density 112 as that of a workstation device 108 with a large display component 110). Therefore, a presentation 102 of a fixed logical size 106 may appear larger, smaller, or the same physical size 116 on the display component 110 of the portable device 108 than on the workstation device 108. Moreover, the user may not understand why this is the case, nor why adjusting the pixel dimensions 114 of the device 108 has an inverse relationship with the physical size 116 of the presentation 102 (e.g., it may seem counterintuitive to the user that increasing the pixel dimensions 114 of the display component 110 decreases the physical size 116 of the presentation 102). Additionally, if rendered in a full-screen manner on the first display component 110 and the second display component 110, the presentation 102 may have the same physical size 116 but a different visual quality on each display component 110. In one such scenario, the presentation 102 may appear clearer on the second display component 110 due to the higher pixel density 112 of the display. However, in another such scenario, the presentation 102 may appear blurry on the second display component 110 due to a scaling that introduces visual artifacts in the appearance of the presentation 102. This diminished appearance may occur even if the second display component 110 is of generally higher visual quality. Due to an incomplete understanding of the different pixel densities 112 of the display components 110, the user may not understand the cause of such visual differences.

In addition to making a presentation 102 with an inconsistent appearance when displayed on different display components 110, or when displayed on the same display component 110 at different pixel dimensions 114, the inflexibility of the presentation 102 to the pixel density 112 of the display component 110 may present practical disadvantages. As a first example, elements 104 presented on a display component 110 at a low pixel density 112 may be very large, and may be difficult for the user to examine (e.g., extending beyond the peripheral vision of the user). As a second example, elements 104 presented on a display component 110 at a high pixel density 112 may be too small to be identifiable or legible, and in some cases, may not even be visible to the user. Such elements 104 may also be too small to select with a pointing device; e.g., many devices 108 feature a touchscreen input that is sensitive to touch from a pointer such as a fingertip or stylus, and a scaled-down representation presented on a portable may be too small to select with the pointer. This disadvantage may arise frequently in the area of portable devices 108, because such devices often feature display components 110 that are touch-sensitive and that also feature high pixel densities 112 in order to present high-quality output on the small display component 110. Thus, the inflexibility of the display of a presentation 102 in view of variable pixel densities 112 of the display components 110 of such devices 108 may present these and other aesthetic and/or practical disadvantages.

B. Alternative Techniques

Some techniques may be utilized to adjust a presentation 102 in view of the variations in pixel densities 112 of the display components 110 upon which the presentation 102 is displayed. As a first such technique, developers may design the presentation 102 with a set of selectable pixel dimensions 114 (e.g., websites existing in different dimensions, such as a first set of web pages viewable at 800×600 pixel dimensions 114, a second set of web pages viewable at 1,024×768 pixel dimensions 114, and a third set of web pages viewable at 1,280×1024 pixel dimensions 114), and may enable visitors to select pixel dimensions 114 that are suitable for the device 108 and display component 110 operated by the user. While providing a greater degree of flexibility than fixed-resolution presentations 102, this technique addresses the problem in an indirect manner (e.g., often compensating for variable pixel densities 112 by completely adjusting the visual layout of the presentation 102), and involve the attention, subjective judgment, and trial-and-error activities of the user to achieve a suitable presentation 102.

Figure 2:
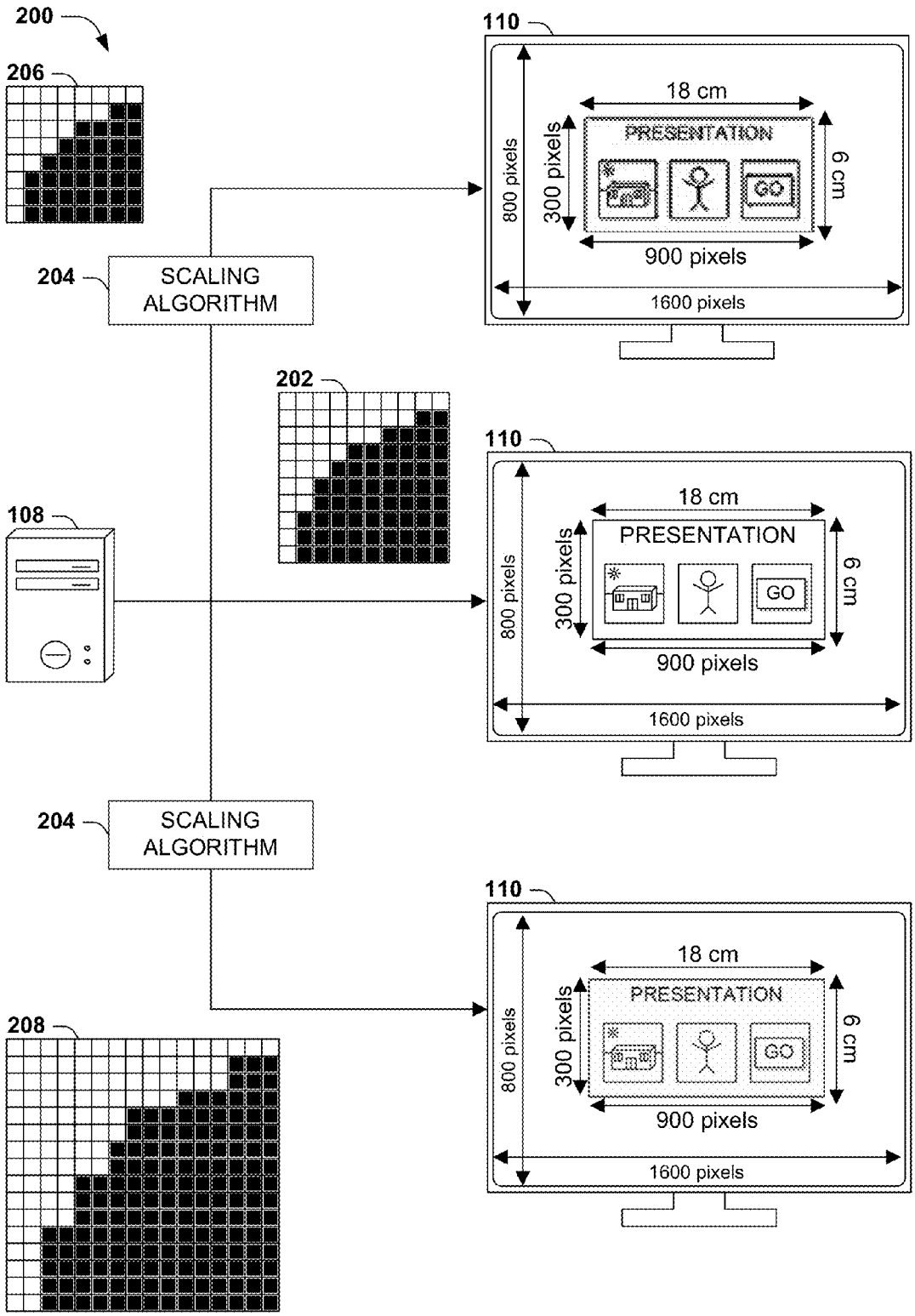
FIG. 2 is an illustration of a first exemplary technique for adjusting a presentation in view of the pixel densities of respective display components.

FIG. 2 presents an illustration 200 of a second such technique, wherein a device 108 is configured to scale presentations 102 in view of the pixel density 112 of the display component 110. In accordance with this technique, the device 108 may render a presentation 102 first to an intermediate bitmap of a logical size 106, and then scale the intermediate bitmap to a scaled bitmap that is presented on the display component 110 at a desired physical size 116. For example, the presentation 102 may first be rendered as a bitmap 202 of a logical size 106. Coincidentally, the second display component 110 may feature a first pixel density 112 that causes the bitmap 202 to appear at a desired physical size 116, and the device 108 may present the bitmap 202 on the second display component 110 without scaling. However, the first display component 110, though of the same size as the second display component 110, may have a lower pixel density 112, and may therefore present the bitmap 202 at an undesirably large size. Therefore, the device 108 may apply a scaling algorithm 204 to generate a downscaled bitmap 206 having lower pixel dimensions 114, and that appears with the desired physical size 116 when presented on the first display component 110. However, the scaling algorithm 204 may introduce artifacts in the bitmap 202; e.g., due to the reduced pixel dimensions 114, the scaling algorithm 204 may transform curves into rough diagonals. The visual effect of such scaling artifacts may be exacerbated when the downscaled bitmap 206 is rendered at a large size on the first display component 110, resulting in a presentation 102 of the desired physical size 116 but with pixelized and diminished visual quality. Conversely, for the third display component 110 having a higher pixel density 112, the device 108 may apply the scaling algorithm 204 to generate an upsampled bitmap 208 that appears on the third display component 110 of the desired physical size 116. However, the scaling algorithm 204 may not have sufficient information to interpolate additional detail into the upsampled bitmap 208 (e.g., the scaling algorithm 204 may not identify the curved shape of the bitmap 202, and the upsampled bitmap 208 may feature a chunkier and uneven curve). Therefore, the presentation 102 may appear on the third display component 110 with the desired physical size 116, but may appear blurry or otherwise distorted.

Additional techniques may be devised used to improve the scaling presented in the exemplary scenario 200 of FIG. 2. For example, anti-aliasing techniques may be provided to achieve more accurate scaling. Alternatively, the scaling may be applied to a rasterized version of the presentation 102 rather than a bitmap 202, leading to scaled representations that preserve the visual layout and relationships of the shapes of the presentation 102. However, such techniques may be highly complex and computationally intensive, and may lead to an inefficient use of computing resources and diminished performance of the device 108 (e.g., delays in the rendering of the presentation 102). Due to this complexity, it may be difficult to utilize such techniques on devices 108 having limited computing resources, such as smartphones, which may be unable to apply such complex techniques in a performant manner. Moreover, any such automated scaling typically loses at least some information and introduces at least some visual artifacts and accuracy in the representation of the presentation 102.

Figure 3:
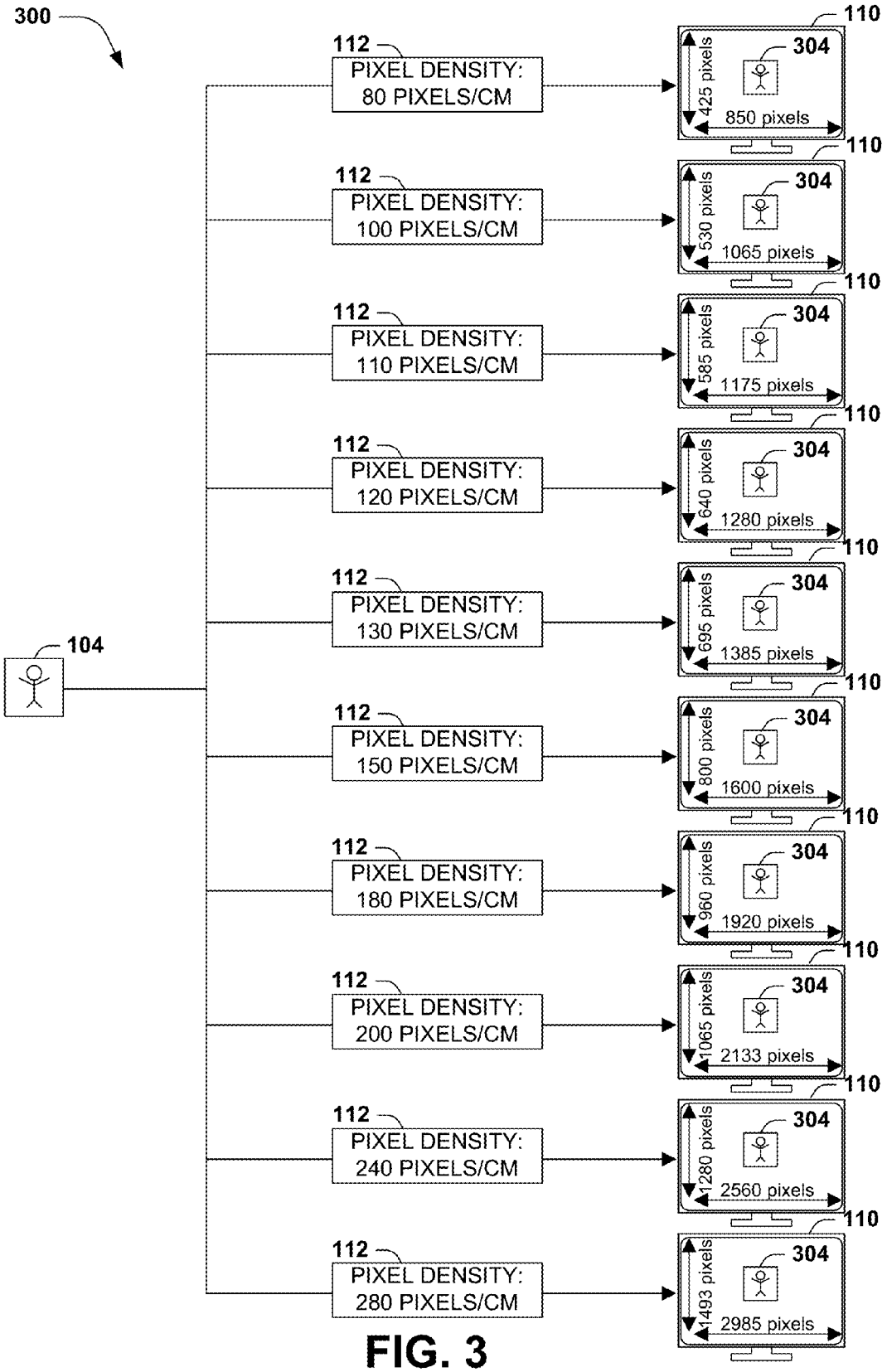
FIG. 3 is an illustration of a second exemplary technique for adjusting a presentation in view of the pixel densities of respective display components.

FIG. 3 presents an exemplary scenario 300 featuring a third technique that may be utilized to achieve the scaling of a presentation 102 in view of the variable pixel density 112 of the display components 110 whereupon the presentation 102 may be displayed. In this exemplary scenario 300, a device 108 may store an element 104 that is capable of generating a scaled representation at any logical size 106 in order to produce a desired physical size 116 on a display component 110 of any pixel density 112. For example, the element 104 may comprise an algorithm that may be invoked to generate an appropriately scaled representation 306 for any pixel density 112, or may comprise a vectorized representation of the element 104 that may be scaled to any desired logical size 106. In this manner, this third technique may achieve a consistent presentation of the element 104 at any pixel density 112 of any display component 110. However, this third technique may also be overly complex and resource-intensive, and may thereby reducing the performance of the device 108, and may be unusable on devices 108 having limited computational resources. Additionally, this third techniques places undue complexity on the designer of the element 104. For example, e.g., the designer of an icon may have to design a large and potentially unlimited number of scaled representations 304 of the icon to satisfy the large and potentially unlimited range of pixel densities 112 of the display components 110 upon which the element 104 may be presented, and the technique may fail if the element 104 is presented on a display component 110 having a pixel density 112 for which a matching scaled representation 306 of the element 104 has not been provided. Alternatively, the designer may design an algorithm to generate the scaled representations 304 of the element 104 under different circumstances, or a vectorized format that may be scaled in view the pixel density 112 of the display component 110, but both techniques may substitute the designer's familiar design tools with unfamiliar, complicated, and expensive drawing algorithm design tools or vector tracing tools.

A fourth technique for scaling elements 104 involves the design of a set of different scaled representations of respective elements 104. For example, in some operating environments, an icon resource may be provided by a developer for display with respect to an application (e.g., the application binary and data files generated and/or consumed by the application). Such icons may also be provided in several logical sizes 106; e.g., an icon resource may include a small version, a medium version, and a large version. In order to represent the application in various contexts, the operating environment may select any of these representations. However, in this technique, the respective icons are intended to be displayed at different sizes in different contexts. For example, the small icon may be presented as a thumbnail representation of the application, e.g., in a notification area; the medium icon may be presented as a notable indicator of the application, e.g., in an application launch menu; and the large icon may be presented within the user interface for the application. That is, the icons within an icon resource not only have different logical sizes 106, but are intended to be displayed at different physical sizes 116 depending on the type of representation of the associated concept, and not at the same size but selected in view of the pixel densities 112 of different display components 110. Moreover, such icons are typically designed with different information in view of the different logical sizes; e.g., the large icon may present a high-resolution logo with the full name of an application, while the medium icon may present a low-resolution logo with an abbreviated name or acronym of the application, and the small icon may present only the low-resolution logo. Thus, the differently sized representations within an icon resource are intended to present different information at different physical sizes 116 in different contexts, not as a consistent physical size 116 across display components 110 having variable pixel densities 112.

C. Presented Techniques

Presented herein are techniques for generating a presentation 102 of elements 104 for display on a display component 110 of a device 108 in a manner that adjusts for the pixel density 112 of the display component 110. In accordance with these techniques, it may be advantageous to devise a scaling technique that involves the designer of an element 104 included in a presentation (e.g., to reduce the inaccuracies that are often introduced by wholly automated scaling techniques), but to reduce the complexity of the design process of such elements 104 (e.g., by not involving the design of an algorithm or vectorized representation of the element 104). Therefore, in accordance with these techniques, a small set of scale factors may be selected as a standard scale factor set. Developers of elements 104 may be advised to generate scaled representations of the element 104 in each scale factor (e.g., at different logical sizes 106 and/or scale percentages). Moreover, each scale factor of the scale factor set may correlate to a pixel density range, and may be used to scale elements 104 for a set of display components 110 within a particular range of pixel densities 112. An embodiment of these techniques may therefore generate a presentation 102 for a particular display component 110 by receiving and/or identifying the pixel density 112 of the display component 110, selecting a scale factor having a pixel density range including the pixel density of the display component 110, and requesting the elements 104 of the presentation 102 to generate a scaled representation 306 using the selected scale factor. The presentation 102 may therefore display the presentation 102 with approximately consistent physical sizes 116 of the elements 104 of the presentation 102 in view of the pixel density 112 of the display component 110.

Figure 4:
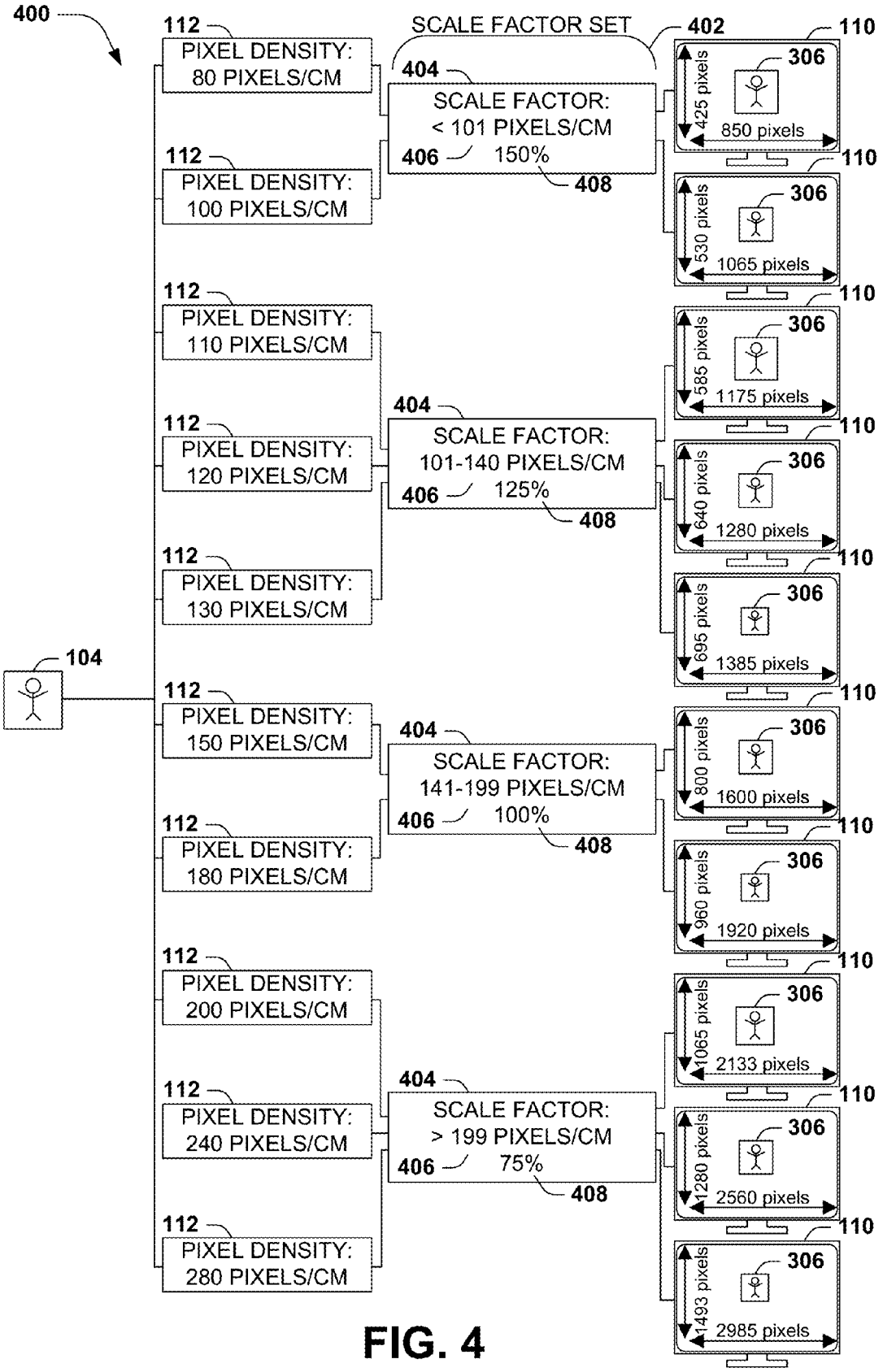
FIG. 4 is an illustration of an adjustment of a presentation in view of the pixel densities of respective display components in accordance with the techniques presented herein.

FIG. 4 presents an illustration of an exemplary scenario 400 featuring an application of the techniques to generate a presentation 102 having elements 104 that having approximately consistent physical sizes 116 when presented on display components 110. In this exemplary scenario 400, an element 104 of a presentation 102 is to be displayed on a variety of display components 110 having different pixel densities 112. However, these techniques utilize a scale factor set 402, comprising a set of scale factors 404 that indicate a pixel density range 406 of pixel densities 112, and a scale factor value 408 to be applied to the elements 104 of the presentation 102 when presented on a display component 110 having a pixel density 112 within the pixel density range 406. Thus, in order to display the presentation 102 on a particular display component 110, the embodiment identifies the pixel density 112 of the display component 110 and selects a scale factor 404 having a pixel density range 406 including the pixel density 112 of the display component 110. The embodiment may then request respective elements 104 to generate a scaled representation 306 using the selected scale factor 404. The scaled representation 306 of the element 104 may then be included in a presentation 102 on the display component 110, and may appear with an approximately consistent physical size 116.

It is noted that this technique may result in a less accurate scaling of the elements 104 of the presentation across display components 110. As a first example, the use of a small scale factor set 402, comprising a small number of scale factors 404 that each applies to a pixel density range 406 of pixel densities 112 may yield an approximately consistent physical size 116 of an element 104 across display components 110. As a second example, the small scale factor set 402 includes a minimum scale factor 404 and a maximum scale factor 404, and therefore does not scale elements 104 presented on display components 104 having unusually large or small pixel densities 112. However, these techniques may present some advantages with respect to alternative techniques, even if such alternative techniques may result in more accurate or robust scaling. As a first example, these techniques involve the attention of a designer in designing the scaled representations 306 of the element 104; e.g., the designer may simply generate one scaled representation 306 for each scale factor 404. The visual quality of the scaled representations 306 is therefore likely to be higher than that of automatically scaled representations 306, such as depicted in the exemplary scenario 200 of FIG. 2. However, the selection of a small number of scale factors 404 may conserve the attention of the designer; e.g., the designer is only asked to design a small number of scaled representations 306, rather than designing scaled representations 306 for many possible pixel densities 112, as in the exemplary scenario 300 of FIG. 3. Moreover, the designer may satisfy this comparatively straightforward task with familiar design tools, rather than having to develop a complex algorithm or a rasterized representation of the element 104. As a second example, the reliance of these techniques on a small number of scaled representations 306 may reduce the computational resources consumed by an embodiment of these techniques. For example, rather than requesting an element 104 to generate a scaled representation 306 on-the-fly for any arbitrarily selected pixel density 112, an embodiment may request the element 104 to generate one of a small number of scaled representations 306, thereby enabling the element 104 to include or pre-render all of the potentially requested scaled representations 306, and/or the use of caching to expedite the reuse of previously generated scaled representations 306. These and other advantages may be achieved through the generation of the presentation 102 with elements 104 scaled according to the pixel density 112 of the display component 110 of the device 108 in accordance with the techniques presented herein.

D. Exemplary Embodiments

Figure 5:
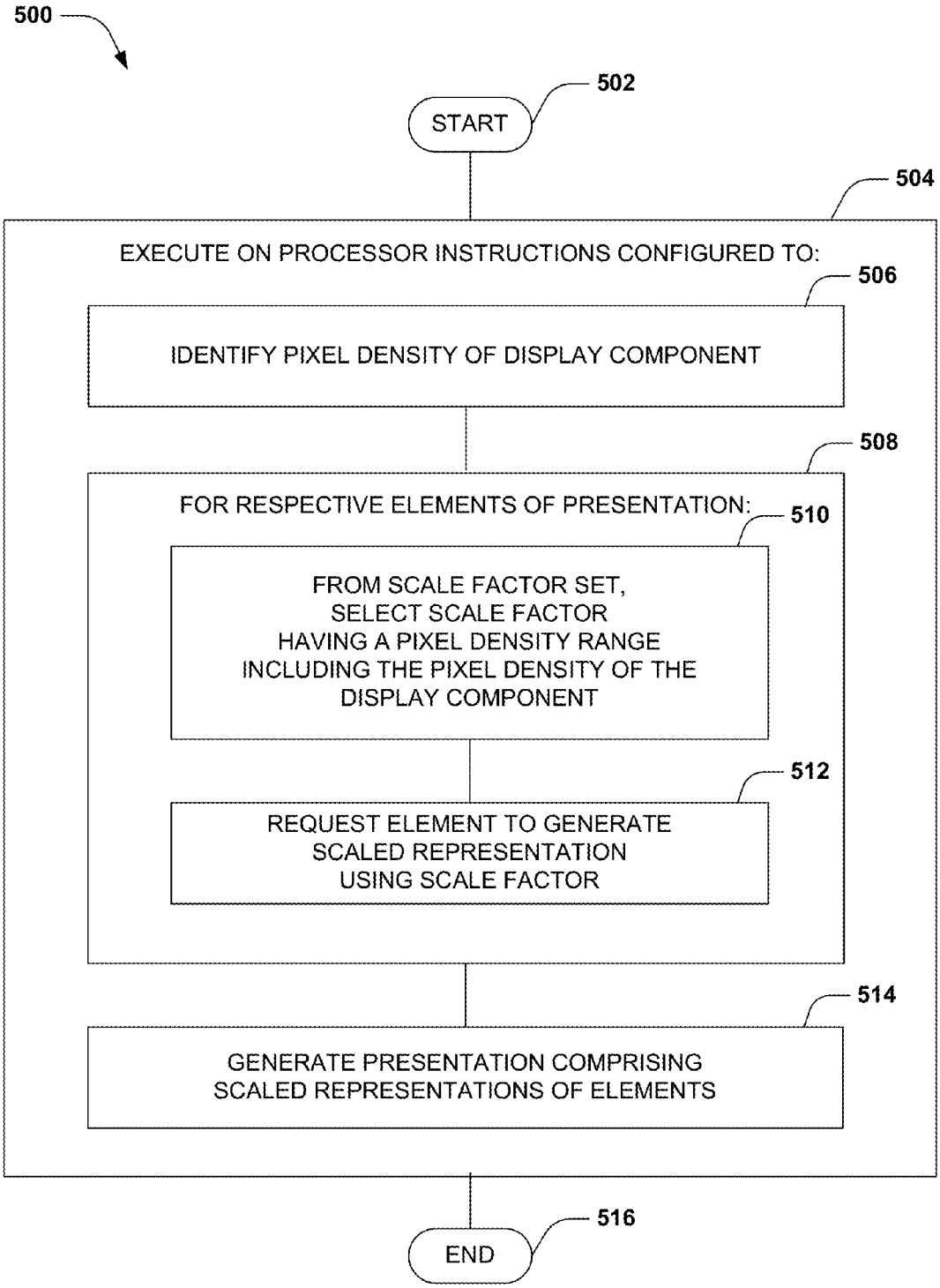
FIG. 5 is a flowchart illustrating a first exemplary method of generating a presentation of elements on display components in accordance with the techniques presented herein.

FIG. 5 presents a first embodiment of these techniques, illustrated as an exemplary method 500 of generating a presentation 102 comprising elements 104 to be displayed on a display component 110. The exemplary method 500 may be implemented, e.g., as a set of instructions stored in a memory component of a device (e.g., a memory circuit, a platter of a hard disk drive, a solid-state memory component, or a magnetic or optical disc) that, when executed by a processor of a device, cause the device to perform the techniques presented herein. The exemplary method 500 begins at 502 and involves executing 504 the instructions on the processor. Specifically, the instructions are configured to identify 506 a pixel density 112 of the display component 110. The instructions are also configured to, for respective 508 elements 104 of the presentation 102, from a scale factor set 402, select 510 a scale factor 404 having a pixel density range 406 including the pixel density 112 of the display component 110; and request 512 the element 104 to generate a scaled representation 306 using the scale factor 404. The instructions are also configured to generate 514 the presentation 102 comprising the scaled representations 304 of the elements 104. Having achieved the generation of the presentation 102 in view of the pixel density 112 of the display component 110 upon which the presentation 102 is to be displayed, the exemplary method 500 achieves the generation of the presentation 102 according to the techniques presented herein, and so ends at 516.

Figure 6:
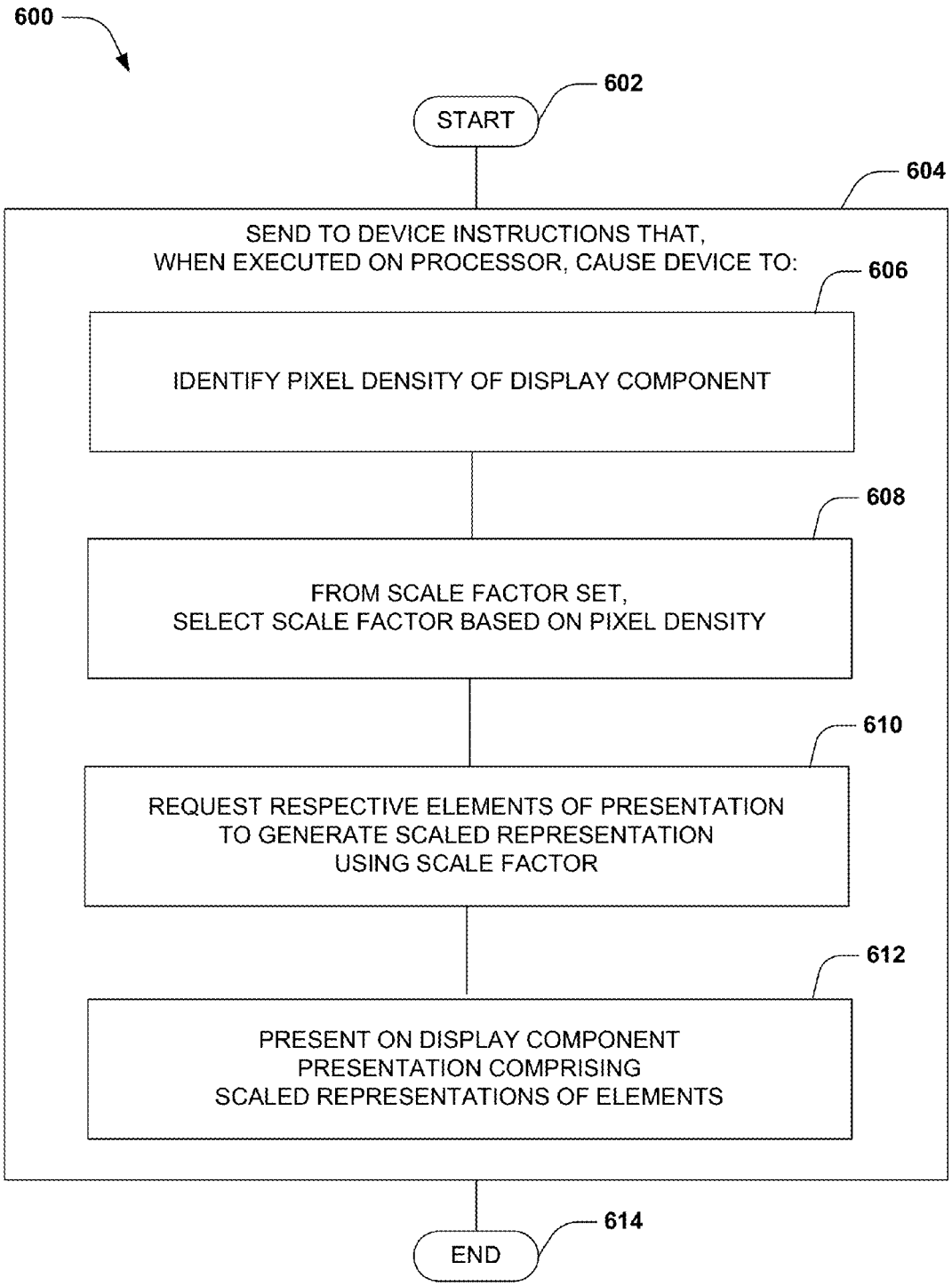
FIG. 6 is a flowchart illustrating a first exemplary method of generating a presentation of elements on display components in accordance with the techniques presented herein.

FIG. 6 presents a second embodiment of these techniques, illustrated as an exemplary method 600 of presenting elements 104 on a display component 110 of a device 108. The exemplary method 600 may be implemented, e.g., as a set of instructions stored in a memory component of a device (e.g., a memory circuit, a platter of a hard disk drive, a solid-state memory component, or a magnetic or optical disc) that, when executed by a processor of a device, cause the device to perform the techniques presented herein. The exemplary method 600 begins at 602 and involves sending 604 the instructions to the device 108. Specifically, the instructions are configured to identify 606 a pixel density 112 of the display component 110, and from a scale factor set 402, select 608 a scale factor 404 based on the pixel density 112. The instructions are also configured to request 610 respective elements 104 to generate a scaled representation 306 using the scale factor 404. The instructions are also configured to present 612 on the display component 110 a presentation 102 comprising the scaled representations 304 of the elements 104. Having achieved the presentation 102 of the elements 104 in view of the pixel density 112 of the display component 110 upon which the presentation 102 is to be displayed, the exemplary method 600 achieves the generation of the presentation 102 according to the techniques presented herein, and so ends at 614.

Still another embodiment involves a computer-readable medium comprising processor-executable instructions configured to apply the techniques presented herein. Such computer-readable media may include, e.g., computer-readable storage media involving a tangible device, such as a memory semiconductor (e.g., a semiconductor utilizing static random access memory (SRAM), dynamic random access memory (DRAM), and/or synchronous dynamic random access memory (SDRAM) technologies), a platter of a hard disk drive, a flash memory device, or a magnetic or optical disc (such as a CD-R, DVD-R, or floppy disc), encoding a set of computer-readable instructions that, when executed by a processor of a device, cause the device to implement the techniques presented herein. Such computer-readable media may also include (as a class of technologies that are distinct from computer-readable storage media) various types of communications media, such as a signal that may be propagated through various physical phenomena (e.g., an electromagnetic signal, a sound wave signal, or an optical signal) and in various wired scenarios (e.g., via an Ethernet or fiber optic cable) and/or wireless scenarios (e.g., a wireless local area network (WLAN) such as WiFi, a personal area network (PAN) such as Bluetooth, or a cellular or radio network), and which encodes a set of computer-readable instructions that, when executed by a processor of a device, cause the device to implement the techniques presented herein.

Figure 7:
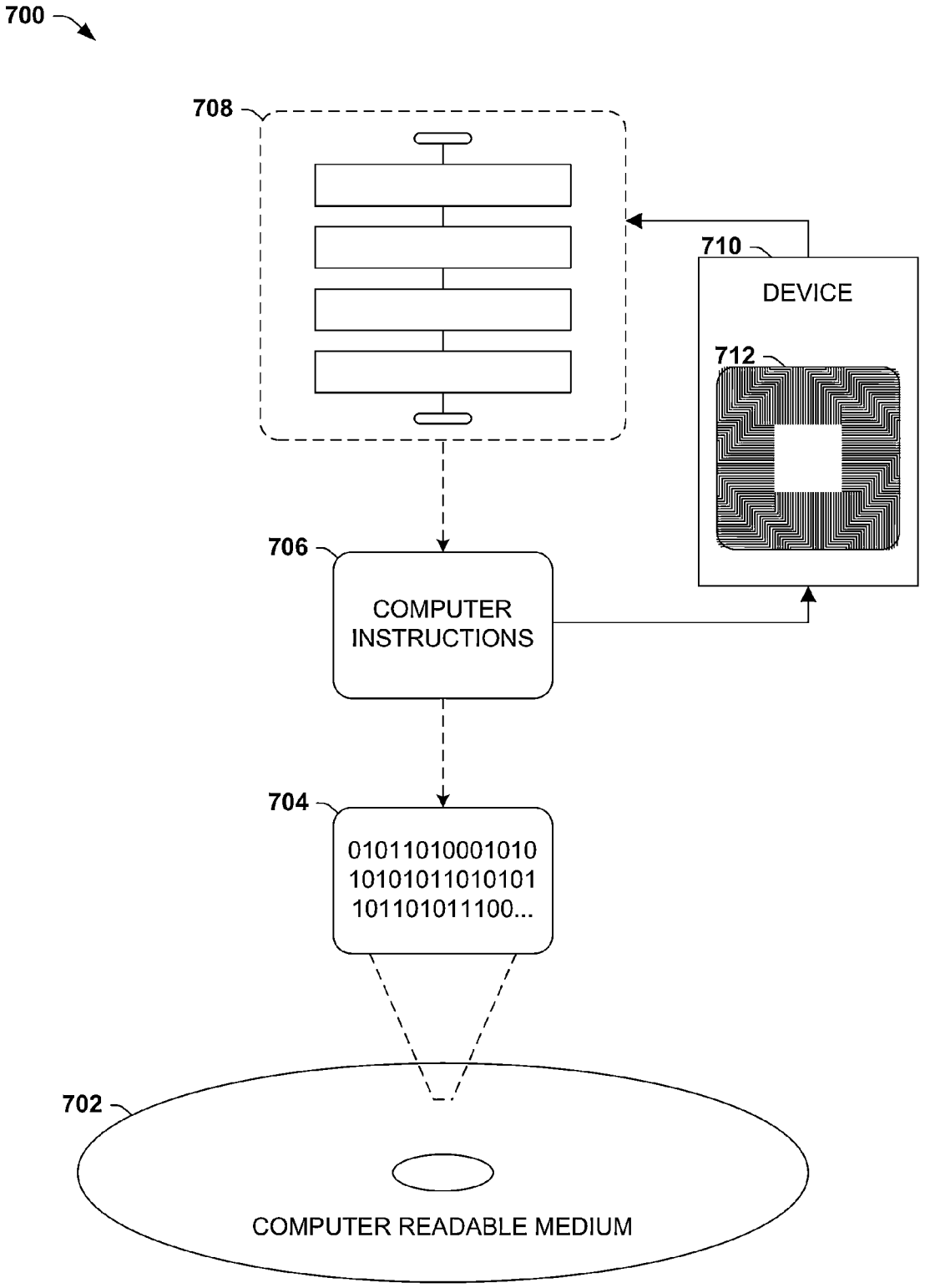
FIG. 7 is an illustration of an exemplary computer-readable medium comprising processor-executable instructions configured to embody one or more of the provisions set forth herein.

An exemplary computer-readable medium that may be devised in these ways is illustrated in FIG. 7, wherein the implementation 700 comprises a computer-readable medium 702 (e.g., a CD-R, DVD-R, or a platter of a hard disk drive), on which is encoded computer-readable data 704. This computer-readable data 704 in turn comprises a set of computer instructions 706 that, when executed by a processor 712 of the device 710, cause the device 710 to operate according to the techniques presented herein. In one such embodiment, the processor-executable instructions 706 may be configured to cause the device 710 to perform a method of generating a presentation of elements on display components, such as the exemplary method 500 of FIG. 5. In another such embodiment, the processor-executable instructions 706 may be configured to cause the device 710 to perform a method of presenting elements 104 on a display component 110 of a device 108, such as the exemplary method 600 of FIG. 6. Some embodiments of this computer-readable medium may comprise a nontransitory computer-readable storage medium (e.g., a hard disk drive, an optical disc, or a flash memory device) that is configured to store processor-executable instructions configured in this manner. Many such computer-readable media may be devised by those of ordinary skill in the art that are configured to operate in accordance with the techniques presented herein.

E. Variations

The techniques discussed herein may be devised with variations in many aspects, and some variations may present additional advantages and/or reduce disadvantages with respect to other variations of these and other techniques. Moreover, some variations may be implemented in combination, and some combinations may feature additional advantages and/or reduced disadvantages through synergistic cooperation. The variations may be incorporated in various embodiments (e.g., the exemplary method 500 of FIG. 5 and the exemplary method 600 of FIG. 6) to confer individual and/or synergistic advantages upon such embodiments.

E1. Scenarios

A first aspect that may vary among embodiments of these techniques relates to the scenarios wherein such techniques may be utilized. As a first variation of this first aspect, these techniques may be used to generate many types of presentations 102 of elements 104, including graphical user interfaces comprising sets of graphical controls; images in an image set, such as a library; and interconnected visual elements in a design drawing, such as an architectural blueprint, manufacturing schematic, or circuit diagram. As a second variation of this first aspect, these techniques may be used to display the presentation 102 on many types of devices 108, including workstation computers, portable computers in notebook or tablet form factor, palmtop computers, smartphones, portable media players, game consoles, and media servers. As a third variation of this first aspect, these techniques may be used to scale the presentation according to the pixel density 112 of many types of display components 110, including a cathode-ray display; a liquid crystal display (LCD); a light-emitting diode (LED) array; a plasma display; and a projector. Such display components 110 may also support many types of features, including light sensitivity, pressure sensitivity, and touch sensitivity to various types of touch input. As a fourth variation of this first aspect, the architecture wherein the technique is utilized may vary in many ways. As a first such example, these techniques may be partly or wholly implemented as a circuit coupled with the display component 110; in a software driver for the display component 110; in a layer of the operating environment of the device 108; or in an application executing on the device 108. As a second such example, two or more devices 108 may interoperate to display the presentation 102 according to the techniques presented herein. As one such example, the display component 110 may be accessible to a second device in communication with a first device 108, and the first device 108 may identify 506 the pixel density 112 by receiving the pixel density 112 of the display component 110 from the second device, and to send the presentation 102 to the second device to be displayed on the display component 110 (e.g., a webserver generating and sending to a client device a web page embedding elements 104 scaled according to the techniques presented herein). Those of ordinary skill in the art may devise many such scenarios wherein the techniques presented herein may be utilized.

E2. Pixel Density and Scale Factors

A second aspect that may vary among embodiments of these techniques relates to the identification of the pixel density 112 of the display component 110 and the selection of a scale factor 404 from the scale factor set 402. As a first variation of this second aspect, the pixel density 112 may be identified in various ways. As a first such example, if the display component 110 is accessible to the device 108 embodying these techniques, the device 108 may be able to query the display component 110 to report the pixel density 112 (e.g., the display component 110 may present an application programming interface (API) through which the properties of the display component 110 may be queried). Alternatively, the device 108 may be able to infer the pixel density 112 of the display component 110, e.g., according to video tests or the performance characteristics of the display component 110. As another alternative, the device 108 may query a user of the device 108 to specify the pixel density 112 of the display component 110.

As a second variation of this second aspect, the scale factors set 402 may be generated in many ways. As discussed herein, it may be advantageous to keep the number of scale factors 404 comparatively small in order to reduce the magnitude of the design task placed on the developers of the elements 104. For example, the scale factor set 402 may include a first scale factor 404 that is selected based on a first pixel density range 406 comprising at least a first pixel density 112 and a second pixel density 112, and a second scale factor 404 that is selected based on a second pixel density range 406 comprising at least a third pixel density 112 and a fourth pixel density 112. The scale factors 404 of the scale factor set 402 may also be selected in view of a target size of the presentation 102; e.g., it may be desirable to render the presentation 102 or the elements 104 at a particular physical size 116, and to select the scale factors 404 in order to scale the presentation 102 and/or elements 104 to the physical size 116 on particular types of devices 108. Additionally, the scale factor set 402 may include a first scale factor 404 indicating a scaling up of the elements 104 (e.g., having a scale factor value 408 greater than one) and a second scale factor 404 indicating a scaling down of the elements 104 (e.g., having a scale factor value 408 less than one), thereby enabling elements 104 to be scaled either up or down according to the pixel density 112 of the display component 110.

As one such example, the scale factors 404 may be selected to position and/or size the elements 104 within a particular element grid, which a designer may devise and utilize to select the positions and/or sizes of elements 104 in order to achieve a desirable alignment. Thus, even if the scaled representations 304 of the elements 104 are presented at different logical sizes 106 within the presentation 102 (in order to appear with approximately consistent physical sizes 116 within the presentation 102 when presented on display components 110 having different pixel densities 112), the elements 104 remain aligned with one another and with other aspects of the presentation 102. Moreover, the element grid may comprise pixel boundaries at particular locations, and the scale factors 404 to be used for the presentation 102 involving the element grid; e.g., the scale factors 404 may be selected to, for elements 104 of an element type having a native size, scale the elements 104 to match the pixel boundaries of the element grid. This selection of scale factors 404 may enable the presentation of scaled representations 304 of the elements 104 without having to adjust for a partial overlapping of a pixel that may lead to visual artifacts.

Figure 8:
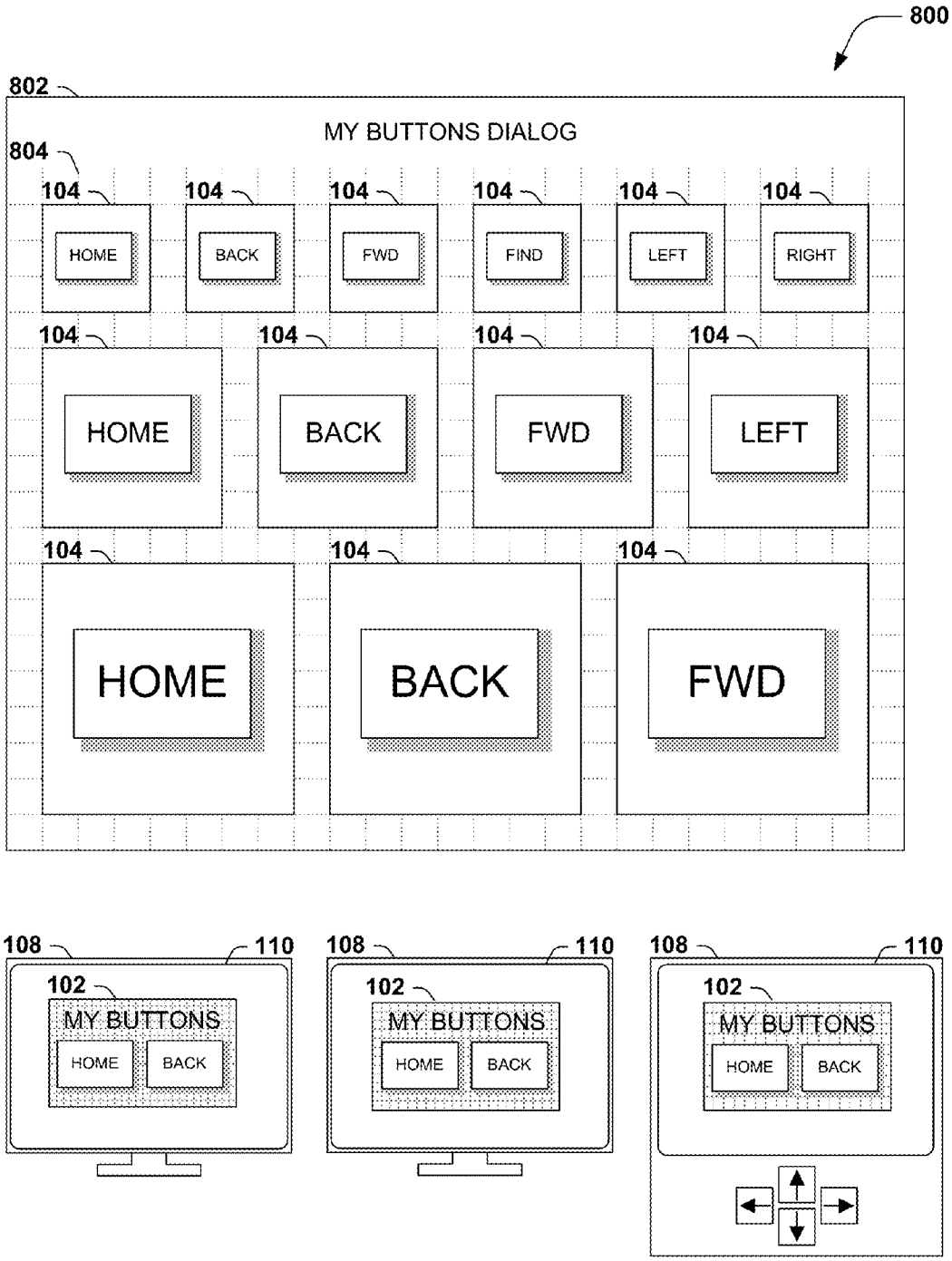
FIG. 8 is an illustration of an exemplary scenario featuring a selection of scale factors for adjusting the elements of a presentation that facilitates positioning of the elements with respect to an element grid.

FIG. 8 presents an illustration of an exemplary scenario 800 featuring an element grid 804 for a particular dialog box 802 containing a set of graphical user interface controls. In this exemplary scenario 800, respective elements 104 of the presentation 102 are to be displayed as scaled representations 304 in order to enable an approximately consistent physical size 116 of the elements 104 despite variable pixel densities 112 of display components 110. In addition, a designer of this presentation 102 may wish to maintain a well-defined position and alignment of the elements 104 of the presentation 102, regardless of which scaled representation 306 is selected. Therefore, the designer may position the elements 104 of the presentation 102 within an element grid 804 that identifies alignment boundaries of elements 104, and may choose the scale factors 404 of the scale set 402 such that the alignment is maintained. Moreover, the designer of this presentation 102 may choose the scale factors 404 of the scale factor set 402 such that each scaled representation 306 meets a pixel boundary; e.g., the percentages comprising each scale factor value 408 may be selected such that the logical size 106 of each scaled representation 306 comprises an integer width and height within the element grid 804, rather than a non-integer floating point value that may overlap part of a pixel, which may result in the application of other scaling techniques (e.g., anti-aliasing) and resulting visual artifacts. Accordingly, when the presentation 102 is displayed on display components 110 of various devices 108, scaled representations 306 of the respective elements 104 may be selected based on the pixel density 112 of the display component 110, and the elements 104 appear at a consistent size and consistent alignment, and without having to utilize other scaling techniques to adapt the scaled representations 306 to the pixel boundaries of the event grid 804.

As a third variation of this second aspect, the scale factors 404 may be adjusted in various ways. As a first such example, the device 108 may enable a user to select a user scale factor in order to specify that the elements 104 of the presentation 102 are to be rendered larger or smaller than by default (e.g., the elements 104 may be scaled down in order to enable the maximize the display space of the operating environment, or may be scaled up in order to facilitate a user with poor vision). Therefore, while selecting scale factors 404 for a presentation 102, an embodiment of these techniques may be configured to select a scale factor 404 from the scale factor set 402 based on the user scale factor as well as the pixel density 112 of the display component 110. For example, in order to scale the elements 104 up in accordance with a user scale factor, the embodiment may identify the scale factor 404 according to the pixel density 112 of the display component 110, and may instead select for application to the elements 104 the next higher scale factor 404 in the scale factor set 402. As a second such example, the selection of the scale factor 404 may be adjusted in view of other considerations (e.g., if the scaled representations 306 of the elements 104 may be disproportionate with other elements of the display 104, or if the scaled presentation 102 may substantially fill or even exceed the resolution of the display component 110, the scaling may be reduced or not performed).

As a fourth variation of this second aspect, the scale factors 404 (including the pixel density ranges 406 and the scale factor values 408) may be specified in various ways. As one such example, the scale factor value 408 may be specified as a percentage of the native sizes of the elements 104, e.g., scaling the element 104 up to 150% of its native size, or down to 75% of its native size. The scaling factor value 408 may also be specified in other ways, e.g., a fixed number of pixels to be added to the width and/or height dimensions of the element 104. As a second such example, the values within the scale factor range 406 may be specified in various ways, such as a horizontal pixel density, a vertical pixel density, or a pixel area density (e.g., pixels/cm$^2$). In particular, the manner of representing the pixel densities 112 of the pixel density ranges 406 of the scale factors 404 may affect the performance of the embodiment. For example, if such pixel densities 112 are specified as pixels per unit (e.g., 100 pixels/cm), and if the display component 110 reports its pixel density 112 as pixels per square unit (e.g., 10,000 pixels/cm$^2$), the device 108 may have to perform a square-root mathematical operation on the reported pixel density 112 in order to compare the values. Because such square-root operations are often slow and may involve floating-point numbers, it may be advantageous to store the pixel densities 112 in the scale factors 404 as a pixel count per square area, so that the values may be directly compared, or may be compared by computing a pixel count per square area from the information reported by the display component 110, which involves a multiplication instead of a floating-point mathematical operation. Those of ordinary skill in the art may devise many such variations in the detection of the pixel density 112 of the display component 110 and the generation and use of the scale factors 404 of the scale factor set 402 in accordance with the techniques presented herein.

E3. Generating Scaled Representations and Presentations

A third aspect that may vary among embodiments of these techniques relates to the manner of generating the scaled representations 306 of the elements 104 and the presentation 102 incorporating such scaled representations 306. As a first variation, one or more scaled representations 306 at respective scale factors 404 may be pre-generated (e.g., by a designer of the element 104 and/or presentation 102) and may be stored by the element 104, and requesting the element 104 to generate a scaled representation 306 may simply involve retrieving the pre-generated scaled representation 306 from the element 104. Alternatively, the element 104 may generate the scaled representation 306 on a just-in-time basis, e.g., when requested for inclusion in a particular presentation 102. In order to improve the efficiency of such generation, an embodiment of these techniques may generate on the device 108 a scaled representation cache, wherein scaled representations 306 generated by respective elements 104 for respective scale factors 404 may be stored for reuse. In this variation, before requesting an element 104 to generate a scaled representation 306 for a particular scale factor 404, the embodiment may first query the scaled representation cache for a scaled representation 306 of the element 104 at the selected scale factor 404, and may retrieve and use a cached scaled representation 306 if located; and upon failing to locate such a scaled representation 306 in the scaled representation cache, the embodiment may, after requesting the element 104 to generate the scaled representation 306, store the received scaled representation 306 in the scaled representation cache associated with the element 104 and the scale factor 404 for later re-use.

As a second variation of this third aspect, an embodiment may vary in some ways in generating of the presentation 102 using the scaled representations 306 of the elements 104. As a first such variation, where respective elements 104 have an element type, the embodiment may selectively request the elements 104 of a first element type to generate scaled representations 306, and may include unscaled representations for elements 104 of a second element type in the presentation 102. For example, where the elements 104 are of element types such as a static image, an animating image, and an interactive control, an embodiment may be configured to scale only the elements 104 comprising interactive controls, because the techniques may be applied only to promote a consistent size among interactive elements 104 (and to render other elements 104 at a native, unscaled size). As a second such variation, the presentation 102 may comprise two or more presentation contexts, and an embodiment may be configured to generate the presentation 102 with scaled representations 304 of the elements 104 for a first presentation context, but to generate the presentation 102 with natively sized and unscaled representations 304 of the elements 104 for a second presentation context. As one such example, a presentation 102 may or may not be presented on a touch-responsive display component 110 that is responsive to fingertip input of a fingertip of a user, and it may be advantageous to apply the scaling techniques only when the presentation 102 is displayed in a touch-responsive presentation (and refraining from scaling the elements 104 in a touch-unresponsive presentation).

As a third variation of this third aspect, an embodiment of these techniques may be configured to reapply the techniques presented herein in the event of a change in the pixel density 112 of the display component 110 upon which the presentation 102 is displayed. As a first such variation, the presentation 102 may be moved from a first display component 110 to a second display component 110 of the same device 108 or a different device 108, and the display components 110 may have different pixel densities 112. As a second such variation, the pixel dimensions 114 of the display component 110 may change, causing a change in the pixel density 112 of the display component 110. Therefore, the scaled representations 306 selected based on the previously selected scale factor 404 may be unsuitable for the second pixel density 112, and the techniques presented herein may be reapplied to generate a second presentation 102 featuring a second set of scaled representations 306 of the elements 104 using a second scale factor 404.

Figure 9:
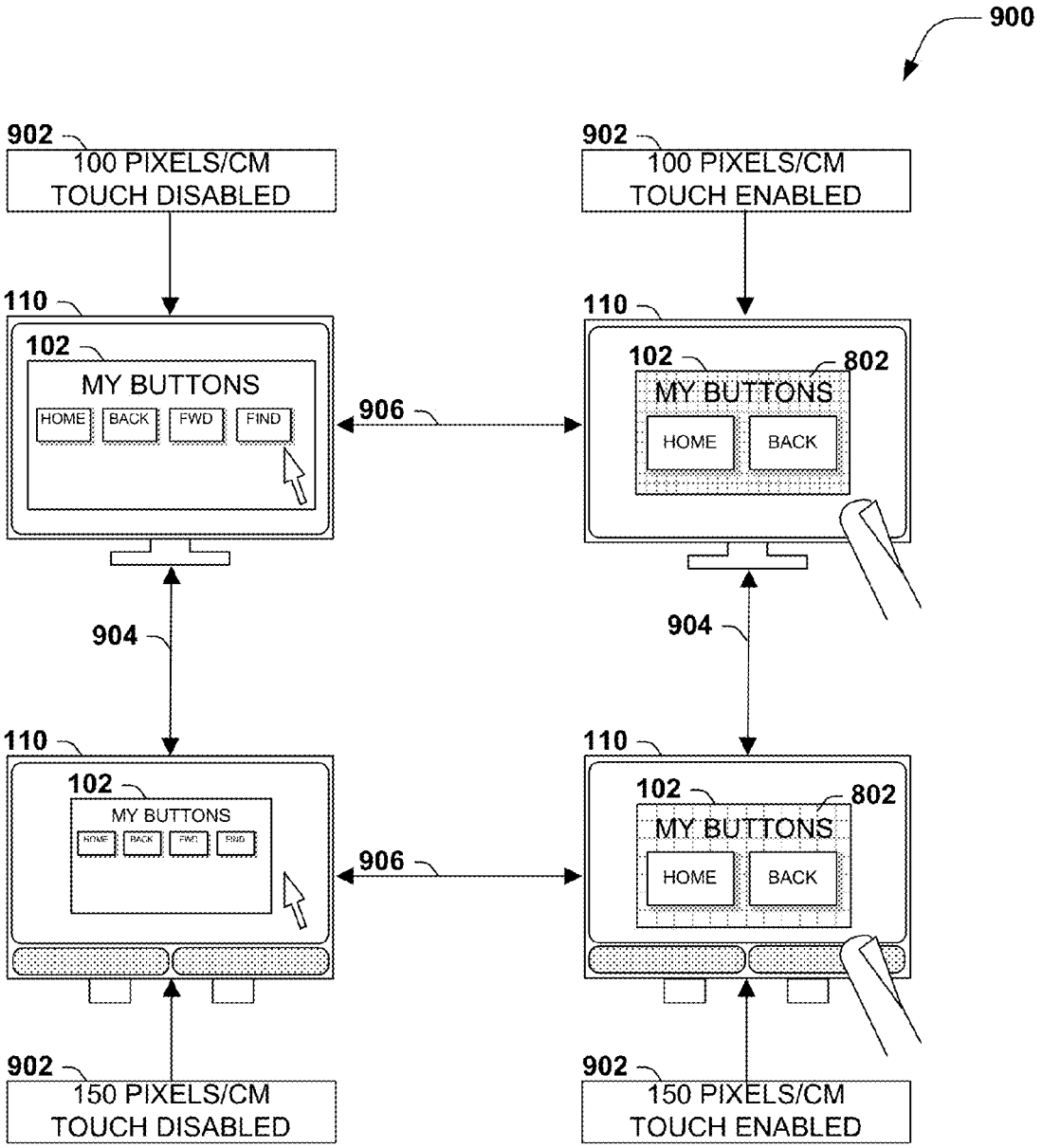
FIG. 9 is an illustration of an exemplary scenario featuring the adjustment of elements of a presentation according to the pixel densities of display components and the presentation context of the presentation.

FIG. 9 presents an illustration of an exemplary scenario 900 featuring a variable application of the techniques presented herein. In particular, this exemplary scenario 900 involves a device 108 having access to two display components 110 that are capable of receiving touch input from a fingertip of a user. However, the display components 110 may operate in a particular touch-responsive mode 902, thereby enabling touch input to be enabled or disabled, and may display and receive input through a pointer or cursor input while touch input is disabled. In this exemplary scenario 900, it may be advantageous to utilize the scaling techniques presented herein to scale the elements 104 comprising the user interface of this presentation 102 for the selected display component 110, and only when the display component 110 is operating in a touch-responsive mode. Thus, when operating on a first display component 110 (illustrated at top left) or a second display component 110 (illustrated at bottom left) when touch input is disabled, the device 108 may not utilize the techniques presented herein, and the presentation 102 may appear at different physical sizes 116 due to different pixel densities 112 of the display components 110 (thus appearing smaller on the second display component 110 having a higher pixel density 112). This difference may be acceptable due to the comparatively high precision of a pointer or cursor; e.g., the user may not have difficulty selecting the elements 104 with a pointer even if rendered at a smaller physical size 116 due to a higher pixel density 112. However, upon detecting a touch mode switch 906 resulting in an enabling of touch input, the device 108 may apply the techniques presented herein to scale the elements 104 in order to achieve a consistent physical size 116 of the presentation 102, e.g., in order to facilitate touch input from the fingertip of the user. Moreover, when detecting a change in the pixel density 112 of the display component 110 upon which the presentation 102 is displayed (e.g., a display component switch 904, such as moving the presentation 102 from the first display component 110 to the second display component 110), the device 108 may reapply the techniques presented herein to rescale the presentation 102 in view of the new pixel density 112. In this manner, the techniques presented herein may be selectively applied to particular element types, presentation contexts, and changes in the pixel density 112 of the display component 110 where the presentation 102 is displayed. Those of ordinary skill in the art may devise many such variations in the application of the techniques presented herein.

F. Computing Environment

Figure 10:
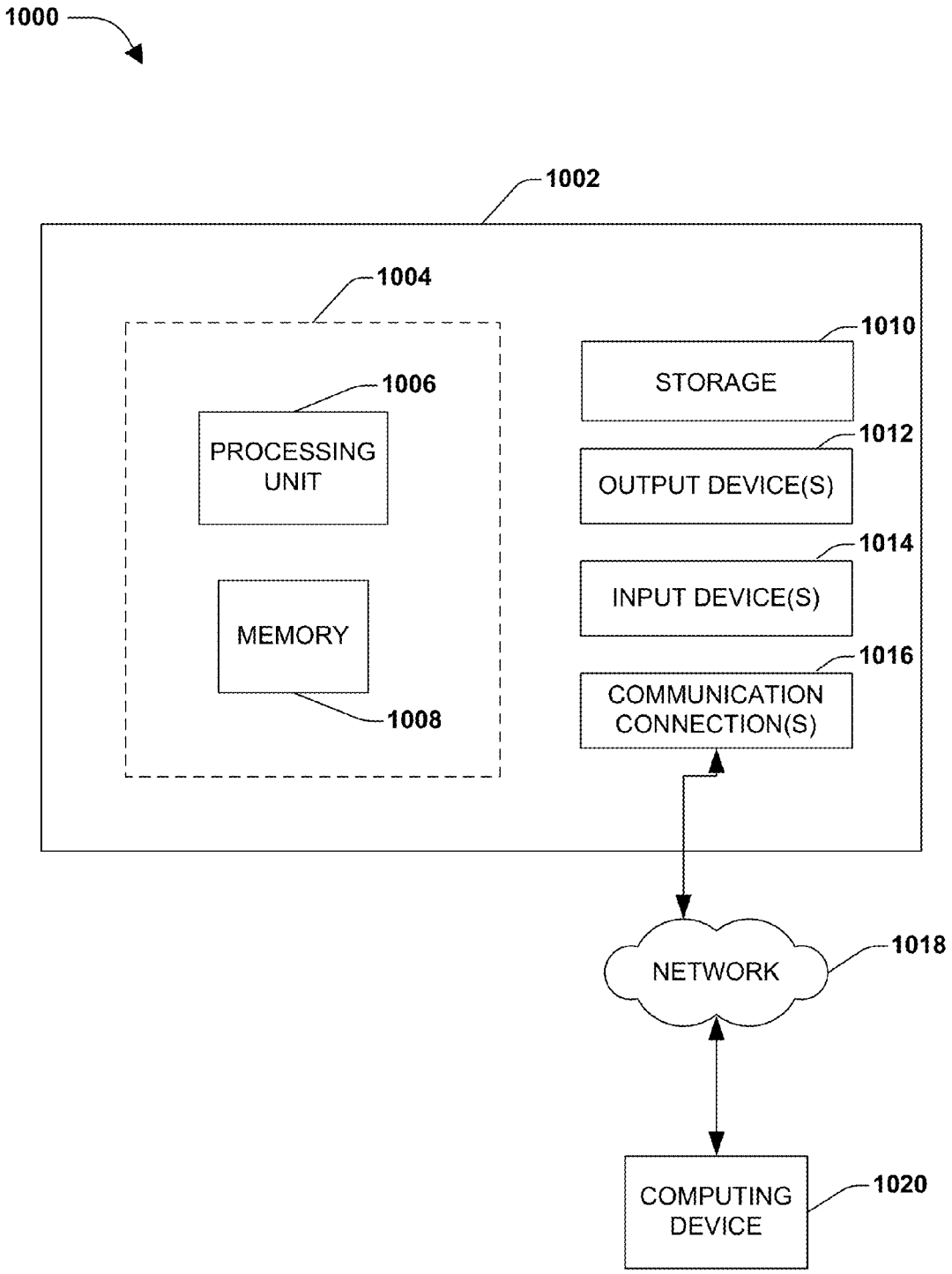
FIG. 10 illustrates an exemplary computing environment wherein one or more of the provisions set forth herein may be implemented.

FIG. 10 presents an illustration of an exemplary computing environment within a computing device 1002 wherein the techniques presented herein may be implemented. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, and distributed computing environments that include any of the above systems or devices.

FIG. 10 illustrates an example of a system 1000 comprising a computing device 1002 configured to implement one or more embodiments provided herein. In one configuration, the computing device 1002 includes at least one processor 1006 and at least one memory component 1008. Depending on the exact configuration and type of computing device, the memory component 1008 may be volatile (such as RAM, for example), non-volatile (such as ROM, flash memory, etc., for example) or an intermediate or hybrid type of memory component. This configuration is illustrated in FIG. 10 by dashed line 1004.

In some embodiments, device 1002 may include additional features and/or functionality. For example, device 1002 may include one or more additional storage components 1010, including, but not limited to, a hard disk drive, a solid-state storage device, and/or other removable or non-removable magnetic or optical media. In one embodiment, computer-readable and processor-executable instructions implementing one or more embodiments provided herein are stored in the storage component 1010. The storage component 1010 may also store other data objects, such as components of an operating system, executable binaries comprising one or more applications, programming libraries (e.g., application programming interfaces (APIs), media objects, and documentation. The computer-readable instructions may be loaded in the memory component 1008 for execution by the processor 1006.

The computing device 1002 may also include one or more communication components 1016 that allows the computing device 1002 to communicate with other devices. The one or more communication components 1016 may comprise (e.g.) a modem, a Network Interface Card (NIC), a radiofrequency transmitter/receiver, an infrared port, and a universal serial bus (USB) USB connection. Such communication components 1016 may comprise a wired connection (connecting to a network through a physical cord, cable, or wire) or a wireless connection (communicating wirelessly with a networking device, such as through visible light, infrared, or one or more radiofrequencies.

The computing device 1002 may include one or more input components 1014, such as keyboard, mouse, pen, voice input device, touch input device, infrared cameras, or video input devices, and/or one or more output components 1012, such as one or more displays, speakers, and printers. The input components 1014 and/or output components 1012 may be connected to the computing device 1002 via a wired connection, a wireless connection, or any combination thereof. In one embodiment, an input component 1014 or an output component 1012 from another computing device may be used as input components 1014 and/or output components 1012 for the computing device 1002.

The components of the computing device 1002 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of the computing device 1002 may be interconnected by a network. For example, the memory component 1008 may be comprised of multiple physical memory units located in different physical locations interconnected by a network.

Those skilled in the art will realize that storage devices utilized to store computer readable instructions may be distributed across a network. For example, a computing device 1020 accessible via a network 1018 may store computer readable instructions to implement one or more embodiments provided herein. The computing device 1002 may access the computing device 1020 and download a part or all of the computer readable instructions for execution. Alternatively, the computing device 1002 may download pieces of the computer readable instructions, as needed, or some instructions may be executed at the computing device 1002 and some at computing device 1020.

G. Usage of Terms

As used in this application, the terms "component," "module," "system", "interface", and the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein.

Moreover, the word "exemplary" is used herein to mean serving as an example, instance, or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A method of generating, using a device having a processor and an operating system, a presentation of an application comprising elements to be displayed on a display component, the method comprising:

executing on the processor instructions that cause the operating system to:

identify a pixel density of the display component;

for respective elements of the presentation:

from a scale factor set comprising at least two scale factors that are respectively associated with a pixel density range, identify a selected scale factor that is associated with a pixel density range including the pixel density of the display component, wherein the scale factor is different from the pixel density of the display component; and request the application to provide a selected representation of the element using the selected scale factor that does not match the pixel density of the display component; and generate the presentation comprising the selected representations of the elements provided by the application and displayed with the selected scale factor.

2. The method of claim 1, wherein:

the display component is accessible to the device; and identifying the pixel density of the display component further comprises: querying the display component to report the pixel density.

3. The method of claim 1, the scale factor set comprising:

a first scale factor selected based on a first pixel density range comprising at least a first pixel density and a second pixel density; and a second scale factor selected based on a second pixel density range comprising at least a third pixel density and a fourth pixel density.

4. The method of claim 1:

respective elements having a native size; and respective scale factors specified as a percentage of the native size of the element.

5. The method of claim 4, the scale factor set comprising:

a first scale factor having a percentage greater than 100%; and a second scale factor having a percentage less than 100%.

6. The method of claim 1:

the presentation comprising a target size; and the scale factor set comprising:

a first scale factor selected to present the presentation at the target size on a first display component having a first pixel density; and a second scale factor selected to present the presentation at the target size on a second display component having a second pixel density.

7. The method of claim 1:

the presentation comprising an element grid; and identifying the selected scale factor further comprising: identifying the selected scale factor to size the elements according to the element grid.

8. The method of claim 7:

the element grid comprising respective pixel boundaries; and identifying the selected scale factor further comprising: identifying the selected scale factor to, for elements of an element type having a native size, scale the elements to match the pixel boundaries of the element grid.

9. The method of claim 1:

the device having a set of pixel dimensions; and identifying the selected scale factor further comprising: from the scale factor set, identifying the selected scale factor based on the pixel density and the pixel dimensions of the device.

10. The method of claim 1:

the device having a user scale factor selected by a user of the device; and identifying the selected scale factor further comprising: from the scale factor set, identifying the selected scale factor based on the user scale factor and the pixel density.

11. The method of claim 1:

at least one element storing, for respective scale factors, a representation of the element associated with the selected scale factor; and requesting the application to provide a representation of the element further comprising: retrieving from the element the representation associated with the selected scale factor.

12. The method of claim 1:

the device having a representation cache; and requesting the application to provide a representation of an element comprising:

querying the representation cache for a representation of the element associated with the selected scale factor;

upon locating the representation in the representation cache, retrieving the representation from the representation cache; and upon failing to locate the representation in the representation cache:

requesting the application to generate the representation of the element using the selected scale factor; and upon receiving the representation of the element from the application, storing the representation of the element associated with the selected scale factor in the representation cache.

13. The method of claim 1:

respective elements having an element type;

requesting the application to provide a representation of an element comprising:

requesting the application to generate a scaled representation of the elements of a first element type, and refraining from requesting the application to generate a scaled representation of the elements of a second element type; and generating the presentation comprising:

the scaled representations of the elements of the first element type, and unscaled representations of the elements of the second element type.

14. The method of claim 13:

the presentation having at least two presentation contexts; and generating the presentation comprising:

while the presentation is in a first presentation context, generating the presentation comprising the representations of the elements of the first element type provided by the application; and while the presentation is in a second presentation context, generating the presentation comprising unscaled representations of the elements of the second element type.

15. The method of claim 14:

the first presentation context comprising a touch-responsive presentation of the display component that is responsive to fingertip input of a fingertip of a user;

the respective at least two scale factors selected to scale touch-responsive elements of the touch-responsive presentation to facilitate fingertip input; and the second presentation context comprising a touch-unresponsive presentation of the display component.

16. The method of claim 1, the instructions configured to, upon receiving a request to present the presentation on a second pixel density that is different from the pixel density:

for respective elements:

identify the second pixel density of the display component;

from a scale factor set, select a second scale factor based on the second pixel density; and request the application to generate a second representation of the element using the second scale factor; and generate a second presentation comprising the second representations of the elements provided by the application.

17. The method of claim 1:

the display component accessible to a second device in communication with the device;

identifying the pixel density comprising: receiving the pixel density of the display component from the second device; and the instructions configured to send the presentation to the second device to be displayed on the display component.

18. A method of presenting elements for a presentation of an application on a display component of a device having a processor and an operating system, the method comprising:

sending to the device instructions that, when executed on the processor, cause the operating system to:

identify a pixel density of the display component;

from a scale factor set comprising at least two scale factors that are respectively associated with a pixel density range, select a scale factor that is associated with a pixel density range including the pixel density of the display component, wherein the selected scale factor is different from the pixel density of the display component;

request the application to provide, for respective elements of the presentation, a representation of the element using the selected scale factor that does not match the pixel density of the display component; and present on the display component the presentation of the application comprising the representations of the elements provided by the application and displayed with the selected scale factor.

19. The method of claim 1, wherein generate the presentation further comprises: generating the presentation comprising the selected representations of the elements received from the application and refraining from rescaling the selected representations according to the pixel density of the display component.

20. A memory device storing instructions that, when executed on a processor of a device comprising an operating system and a display component having a pixel density, present a presentation of an application comprising at least one element, by:

identifying a pixel density of the display component;

from a scale factor set comprising at least two scale factors that are respectively associated with a pixel density range, causing the operating system to identify a selected scale factor that is associated with a pixel density range including the pixel density of the display component, wherein the selected scale factor is different from the pixel density of the display component;

causing the operating system to request the application to provide, for respective elements of the presentation, a representation of the element using the selected scale factor that does not match the pixel density of the display component; and presenting on the display component the presentation of the application comprising the representations of the elements provided by the application and displayed with the selected scale factor.

* * * * *